United States Patent [19]

dePencier

[11] 4,279,237

[45] Jul. 21, 1981

[54] COMBINATION STOVE AND FIREPLACE

[76] Inventor: Robert D. dePencier, P.O. Box 165, Wolfe Island, Ontario, Canada

[21] Appl. No.: 967,981

[22] Filed: Dec. 11, 1978

[30] Foreign Application Priority Data

Dec. 14, 1977 [CA] Canada ..... 293084

[51] Int. Cl.[3] ..... F23L 11/00; F23L 15/00; F24C 1/08

[52] U.S. Cl. ..... 126/77; 126/60; 126/83; 126/202; 126/285 A

[58] Field of Search ..... 126/62, 63, 77, 193, 126/66, 202, 138, 140, 83, 69, 74, 75, 80, 285 A, 289, 290, 60

[56] References Cited

U.S. PATENT DOCUMENTS

| | | | |
|---|---|---|---|
| 4,585 | 6/1846 | Cobb | 126/289 |
| 7,608 | 8/1850 | Stuart | 126/62 |
| 119,949 | 10/1871 | Perry et al. | 126/193 |
| 740,674 | 10/1903 | March | 126/66 |
| 876,909 | 1/1908 | Oblinger | 126/83 |
| 974,290 | 11/1910 | Merritt | 126/77 |
| 1,938,462 | 12/1933 | Rasanen | 126/75 |
| 4,006,733 | 2/1977 | Crownover | 126/202 X |
| 4,127,100 | 11/1978 | Baker | 126/66 X |
| 4,136,663 | 1/1979 | Gneitins et al. | 126/63 |
| 4,154,212 | 5/1979 | Wilkenson | 126/77 |
| 4,192,285 | 3/1980 | Nietupski | 126/83 |

FOREIGN PATENT DOCUMENTS

| | | | |
|---|---|---|---|
| 1032430 | 7/1953 | France | 126/83 |
| 258656 | 4/1913 | Sweden | 126/77 |

OTHER PUBLICATIONS

Reginald Stoves Nos. 101 and 102; The Fireplace Center, 861 Boyd Ave., Ottawa, (12-6-77) appeared as advertisement in Ottawa Citizen newspaper).

The Fisher Stove, by Eastern Ontario Stove Works, 5 Victoria St., Marmora, Ontario (1976).

Jotal Stoves by DeLuxe Equipment Inc., Montreal (1976).

*Primary Examiner*—Allan N. Shoap

*Attorney, Agent, or Firm*—Fleit & Jacobson

[57] ABSTRACT

The specification describes a stove which is convertible to a fireplace. The stove has a swingable mounted front door which closes the combustion chamber. The door has a primary and secondary pre-heating air passages both of which introduce a stream of pre-heated air to the appropriate regions of the combustion chamber. A slidable baffle system located in the chamber provides a wide range of fuel drafting arrangements. The stove further has a fire screen mounted on the front and which swings from the side opposite the door to conveniently accommodate conversion from closed combustion to a fireplace mode.

6 Claims, 6 Drawing Figures

COMBINATION STOVE AND FIREPLACE

This invention relates to stoves and convertible stove/fireplaces.

When fuel, particularly wood is burned combustible volatiles often pass into the flue unoxidized and deposit there or are expelled unburnt. It is desirable that such volatiles should burn to a maximum extent within the combustion chamber of a stove. The temperature and the presence of adequate oxygen will determine whether or not such materials will burn. This invention contemplates the supplying of two streams of pre-heated air into a stove combustion chamber using the front door of the combustion chamber as a pre-heater and to direct primary pre-heated air to the primary combustion region where the fuel is, and secondary pre-heated air to a region within the chamber through which volatile laden combustion gas moves on its way to the flue. The embodiments of the invention which are described further provide a wide range of fuel drafting arrangements to accomodate efficient drafting from laying various fuels in a cold chamber through to a closely damped fire in a hot chamber and including a convenient conversion for use in a fire place mode. The range of drafting arrangements are provided by the openable front door, draft controls on both primary and secondary air inlets in the door, a baffle arrangement that permits simple adjustment of the flow path of combustion gas through the chamber and a conveniently disposed fire screen for use in the fireplace mode.

It is believed that the essence of the invention is as follows:

in a stove having a combustion chamber, side walls, a rear wall, a bottom and a top, with a flue communicating with the chamber the improvement consists essentially of; a front door, which swingably effects closure of the combustion chamber the door embodying a primary air pre-heating passage of substantial length relative to the width of the door having a discharge orifice adjacent the bottom of the chamber, the door further embodying a secondary air pre-heating passage of substantial length relative to the width of the door, having a discharge orifice into the upper portion of the chamber and primary and secondary air inlet controls mounted in the frontface of the door; and a baffle arrangement disposed in the upper portion of the chamber permiting simple adjustment of the flow path of combustion gas through the chamber.

In drawings which illustrate one embodiment of the invention,

Figure 2:
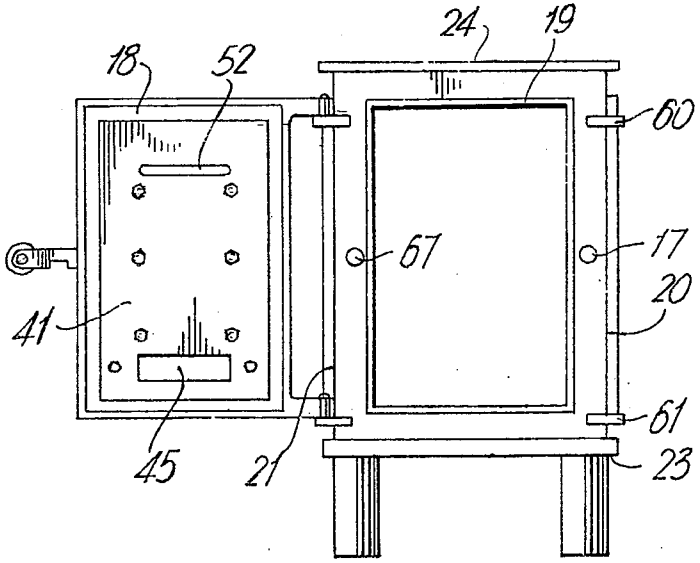
FIG. 2 is a front view of the stove with the door open.

In this embodiment of the invention the stove comprises a front door 10 swingably mounted on one side of the front frame 11 having lugs 12 and 13 which cooperate with complementary eye members 14 and 15 on one side of the door. The door 10 is held in a closed position by a latch lever 16 in combination with latch bolt 17. An asbestos rope 18 shown in FIG. 2 is located in a channel, which follows the outer edge of the door, and in combination with a complementary outwardly extending ridge 19 on the front frame effects closure in the stove mode. The combustion chamber shown is a rectilinear configuration comprising side walls 20 and 21, a rear wall 22, a bottom 23 and a top 24. Opening 25 in the top member 24 communicates with a flue. The lower section of the side and rear walls of the combustion chamber 19 is lined with firebricks 26 to protect the primary combustion region.

Figure 5:
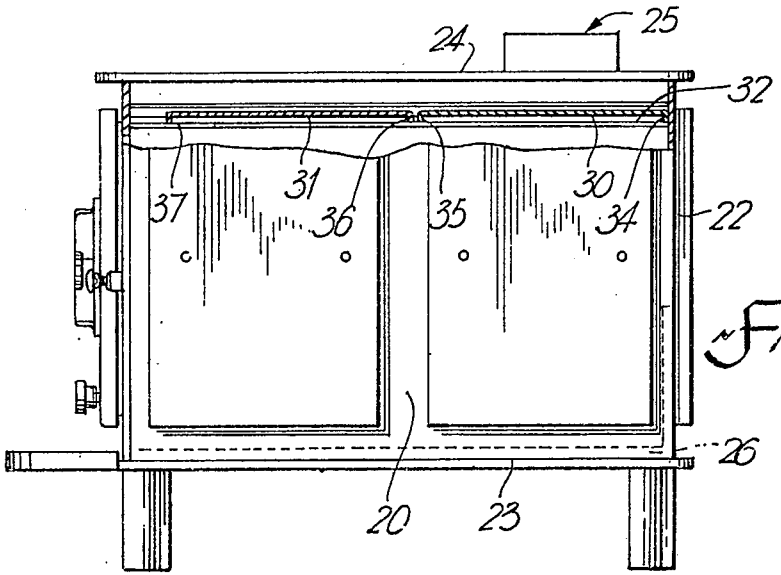
FIG. 5 is a side plan view of the stove.

The upper region of the combustion chamber contains longitudinally slidable baffles 30 and 31, shown in FIG. 5, as flat plates, which rest on a rib 32 attached to side wall 20 and a rib (not shown) attached to the other side wall. Each baffle has depending transverse lips 34, 35 and 36 and 37 at the ends to provide an engaging surface to facilitate the longitudinal positioning of the baffles within the chamber by any conventional manner, such as, a poker or similar object introduced through the front door opening.

The flat lower surfaces of the abutting flat plates or baffles near and in combination with the flat upper surface of the rib 32 on side wall 20 and the rib (not shown) on side wall 21 effectively and selectively seals the upper portion of the chamber from the combustion chamber. The depending transverse lips, additionally, present an obstruction to the flow of the combustion gas causing some turbulance, which, as will be described later, adds to the effectiveness of the stove.

Although the baffle system described comprises flat plates which rest on ribs, it is to be understood that other configurations cast to include features which will affect the gas flow path and result in turbulances analogous to those created by the depending lips, are contemplated.

Figure 4:
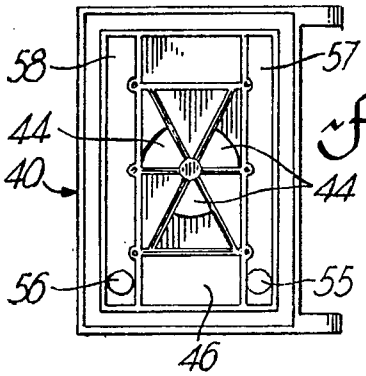
FIG. 4 is a rear view of door outer shell.
Figure 1:
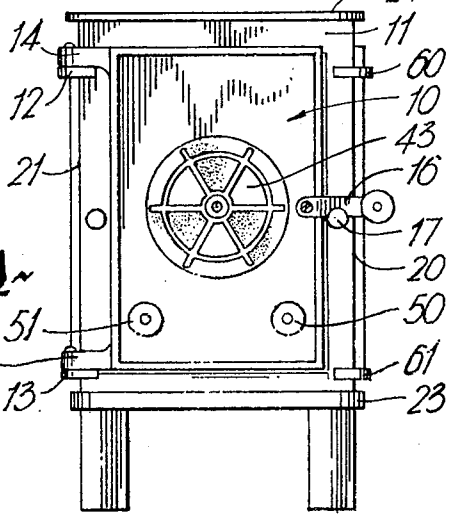
FIG. 1 is a front view of the stove.
Figure 3:
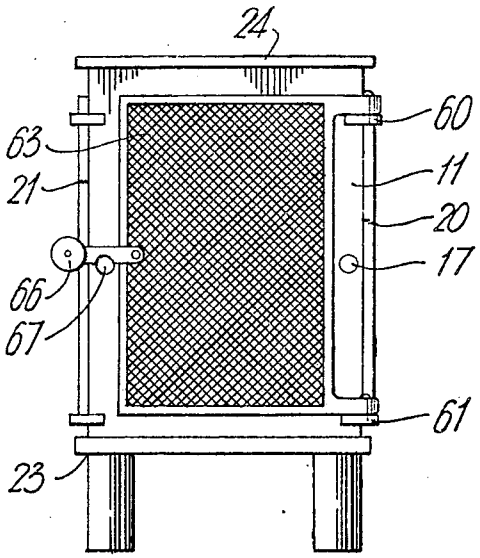
FIG. 3 shows the fire screen in position.

The front door consists of an outer shell 40 and an inner plate 41. The outershell 40, shown more clearly from the rear in FIG. 4, contains a network of webs which define compartments. The inner plate 41 shown in FIG. 2 is supported on the web network to further enclose the compartments thereby forming passages. A generally circular shaped primary air wheel 43 is rotatably mounted on the front face of the outer shell and consists of three triangular shaped sections. Similar triangular shaped primary air inlets 44 are located in the outer shell as shown in FIG. 4. The primary air discharge orifice 45 located in the inner plate of the front door communicates with the air inlets 44 through the connecting passage 46.

Two circularly shaped rotatable controls 50 and 51 are located in inlet openings 55 and 56 on the front face of the outer shell of the door. As controls 50 and 51, which are mounted on screws afixed to the inner plate, are rotated they move in or out of the openings and vary the amount of air permitted to enter passages 57 and 58. A single, secondary air discharge orifice 52 in the inner plate of the front door communicates with the air inlet openings 55 and 56 through secondary air passages 57 and 58 formed by webs in the outer shell in combination with the inner plate 41.

A second pair of lugs 60 and 61 identical to lugs 12 and 13 are provided on the front frame 11 on the side opposite the door 10, swingably support a fire screen 63 having complementary eye members 64 and 65. The fire screen 63 is held in position in front of the open chamber by latch lever 66 in combination with latch bolt 67.

The identical pair of lugs and latch bolts attached to the front frame enables the stove to be assembled with a left or right "hand" door without modifying the frame.

Removable side panels, best shown in FIG. 5, offer an opportunity to decoratively modify the external appearance of the stove, and offer some enhanced convection properties thus increasing efficiency.

In operation the convertible stove/fireplace may be conveniently converted from one mode to the other. In the stove, or closed combustion mode, the fuel, preferably wood, is layed in the combustion chamber 19 and caused to ignite. The longitudinally slidable baffles 30 and 31 are positioned forward inthe chamber, providing a slot shaped opening at the rear of the baffles for combustion gas to exit the chamber through the flue opening 25. The secondary air controls 50 and 51 are in a closed position. The primary air inlet wheel 43 is rotated to a position such that the openings in the outer sheet of the door are fully open. Primary air to support combustion enters the primary air passage in the door through the primary air inlet openings and is discharged through the orifice 45 in the inner plate near the bottom of the combustion chamber. Of course initial laying of the fuel, preferably wood, may be effected with the front door in an open position. The baffles in a forward position present an unimpeded path for combustion gases to exit the combustion chamber, and efficiently draft the fuel.

After the fire is established and the front door 10 is in a closed position, the primary air inlet wheel 43 is rotated such that the wheel sections cover part of the inlet openings 44 in the outer shell, thereby restricting the flow of primary combustion air. The air flow is controlled to the minimum which will sustain combustion. As the heat in the combustion chamber 19 is imparted to the front door, the primary air traversing the primary air passage is heated and is discharged through the orifice 45 pre-heated.

Coincident with the reduction in primary air entering the chamber, the baffles 31 and 32 are longitudinally slid towards the rear of the combustion chamber. This reduces the gap at the rear of the chamber and causes some of the combustion gas to follow a secondary path along the underside of the baffles before exiting the chamber. Finally the baffles in combination are positioned full rearward causing all of the combustion gas to travel to the front of the combustion chamber on its way to the flue opening. At this time the secondary air inlet controls 50 and 51 are rotated to allow secondary air to pass through the inlet openings 55 and 56 in the outer shell. The secondary air travelling through the passages 51 and 58 in the door is pre-heated before being discharged through the orifice 52. This pre-heated air, entering the combustion chamber in the region through which the combustion gas passes on its way to the flue opening 25 provides the necessary oxygen to promote secondary combustion of the volatile laden gases which have also been heated by virtue of an extended path of travel. As indicated previously the turbulances of the gases caused by the depending transverse lips on the slidable baffles further lengthens this flow path, and increases the heat imparted thereto. The secondary combustion burns off the volatiles before they exit the chamber to escape the flue. The secondary combustion of these gases also leads to additional heat generation in the chamber, and contributes to the overall external efficiency of the stove.

A wide range of fuel drafting possibilities in the closed combustion or stove mode are thus possible. The primary air inlet wheel 43 may be virtually closed for holding fires over night, or full opened to promote starting of the fire or to assist in burning wet or otherwise hard to burn fuel. The slidable baffles 30 and 31 may of course, be positioned in a variety of configurations.

Figure 6:
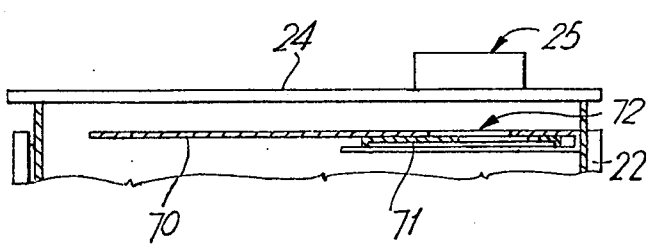
FIG. 6 shows a second embodiment of the baffle arrangement.

A second embodiment of the slidable baffle system shown in FIG. 6 contemplates a fixed baffle 70 positioned in the previously described full rearward location. A small secondary, slidable baffle 71 covers an opening 72 in the fixed baffle 70 at a location near the flue opening 25 in the top 24 member. The secondary slidable baffle 71 may be opened to permit direct gas flow to the flue, or closed thereby forcing the gas to travel to the front of the chamber before exiting.

In the fireplace mode the front door 10 is swung to a position at the side of the stove. The fire screen 63, which is maintained at a position along the opposite side during operation in the stove mode is swung into position in front of the open chamber, and secured in place with the latch lever 66 in combination with the latch bolt 67.

While a preferred embodiment of the invention has been illustrated and described, it will be understood by those skilled in the art that changes and modification may be made therein without departing from the invention in its broader aspects. Various features of the invention are defined in the following claims.

The embodiments of the invention in which an exclusive property or privilege is claimed are defined as follows:

1. A stove having opposing side walls, a rear wall, a bottom wall and a top wall, the walls being interconnected to each other to define a combustion chamber, a flue communicating with said chamber, a front door swingably effecting closure of said combustion chamber, said door embodying therein a primary air preheating passage of substantial length relative to the width of the door and having a discharge orifice adjacent the bottom wall of the chamber, said door further embodying therein a secondary air pre-heating passage of substantial length relative to the width of the door and having a discharge orifice into an upper portion of the chamber, said door consisting of an outer shell and an inner plate cooperating with the outer shell to define therebetween walls of said primary and said secondary passages, said outer shell including a front face and a network of webs which define the paths of the primary and secondary air pre-heating passages and support the inner plate, primary and secondary air inlet controls mounted in a front face of the door for controlling admission of air into said primary and secondary air pre-heating passages; longitudinally slidable baffle means disposed in the upper portion of said chamber for providing simple adjustment of the flow path of combustion gas through said chamber into said flue, said baffle means comprising at least two combustion gas baffles each supported by both opposing side walls of the chamber, said baffles being longitudinally slidable of the fire chamber and spaced from the top thereof to enable variation of the path of flow of the combustion gas to the flue, each baffle comprising a plate having a depending transverse lip resting on a rib on each side wall for longitudinal positioning thereof.

2. The stove according to claim 1 in which said side walls, rear wall, top wall and bottom wall are metal plates welded together and including a front metal frame, a pair of lugs welded to one side of said frame, complementary eye members on one side of said door for swingable mounting of said door upon said lugs and latch means on the opposite side of said door and said frame.

3. The stove according to claim 1 in which said side walls, rear wall, top wall and bottom wall are cast and include a front metal frame, a pair of lugs on one side of said frame, complementary eye members on one side of said door for swingable mounting of said door upon said lugs and latch means on the opposite side of said door and said frame.

4. A convertible wood stove and fireplace having a generally rectilinear combustion chamber formed by interconnected side walls, a rear wall, a top wall, a bottom wall and a front frame, a flue communicating with said chamber, a front door swingably mounted on one side of the frame so as to effect closure of said chamber for a stove mode of usage and to open said chamber for a fireplace mode of usage, a fire screen swingably mounted on the other side of said frame so as to effect screened closure of said chamber when said door is open for a fireplace mode of usage, said door embodying a primary air pre-heating passage of substantial length relative to the width of the door and having a discharge orifice adjacent the bottom of the chamber, said door further embodying a secondary air pre-heating passage of substantial length relative to the width of the door and having a discharge orifice into the upper portion of the chamber, primary and secondary air inlet controls mounted in the front face of the door for controlling admission of the air into said air pre-heating passages, and at least two combustion gas baffles mounted at the side walls for longitudinally slidable movement in the fire chamber and spaced from the top thereof to enable variation of the path of flow of combustion gas to the flue.

5. A stove according to claim 4, in which said door consists of an outer shell and an inner plate cooperating with said outer shell to define therebetween walls of said passages, and said outer shell includes a front face and a network of webs which define paths of said passages and support the inner plate, and said side walls, rear wall, top wall and bottom wall are metal plates welded together with the front frame, a pair of lugs welded to one side of said frame, complementary eye members on one side of said door for swingable mounting of said door upon said lugs and catch means on the opposite side of said door and said frame.

6. A stove according to claim 5 in which said door consists of a cast outer shell and an inner plate cooperating to define therebetween the walls of said passages and a second set of lugs welded to the opposite side of said frame, complementary eye members on one side of a fire screen for swingable mounting of said fire screen upon said second pair of lugs, and catch means on the opposite side of said fire screen and said frame.

* * * * *